United States Patent [19]

Swanson et al.

[11] Patent Number: 4,540,301

[45] Date of Patent: Sep. 10, 1985

[54] APPARATUS FOR APPLYING LIQUID COATINGS

[76] Inventors: Dennis E. Swanson, Rte. 3, Box 143 K, Buffalo, Minn. 55313; Robert D. Lerum, 6641 Berkshire La., Maple Grove, Minn. 55369

[21] Appl. No.: 562,180

[22] Filed: Dec. 16, 1983

[51] Int. Cl.[3] ..... B05C 17/02

[52] U.S. Cl. ..... 401/146; 401/149; 401/188 R; 401/197; 401/206; 401/208; 401/279; 251/289

[58] Field of Search ..... 401/146, 149, 188 R, 401/197, 279, 208, 206; 251/289

[56] References Cited

U.S. PATENT DOCUMENTS

| | | | |
|---|---|---|---|
| 1,875,574 | 9/1932 | Duncan | 251/289 X |
| 2,916,755 | 12/1959 | De Bozzay | 401/197 |
| 3,103,690 | 9/1963 | Day | 401/206 X |
| 3,195,170 | 7/1965 | Howard | 401/188 |
| 3,418,054 | 12/1968 | Kirch | 401/188 |
| 3,457,017 | 7/1969 | Bastian | 401/146 |
| 3,850,408 | 11/1974 | Shelnick | 251/289 X |
| 4,217,062 | 8/1980 | Trp et al. | 401/197 X |
| 4,231,668 | 11/1980 | Groth et al. | 401/146 |

FOREIGN PATENT DOCUMENTS

| | | | |
|---|---|---|---|
| 129491 | 10/1948 | Australia | 401/279 |
| 868894 | 5/1961 | United Kingdom | 401/150 |

*Primary Examiner*—Steven A. Bratlie
*Attorney, Agent, or Firm*—John L. Schmitt

[57] ABSTRACT

A peristaltic-type pump having an intake which may be conveniently connected to a liquid coating source includes an impeller having a pair of rollers. Rotation of the impeller causes the rollers to progressively compress a length of tubing in the pump. This compression creates suction to draw the coating material into the pump and pressure to drive a flow of coating to a handle attached to an applicator. The handle includes flow control devices which may be selectively operated to supply coating to the applicator only as required. During periods of non-flow the coating pressure is sensed to deactivate the pump when the pressure exceeds a preselected limit. Deactivation of the pump saves energy and prolongs a life of the pump.

6 Claims, 24 Drawing Figures

APPARATUS FOR APPLYING LIQUID COATINGS

BACKGROUND OF THE INVENTION

1. Field of the Invention

This invention relates to apparatus for applying liquid coatings and more particularly to apparatus useable by a nonprofessional wherein paint may be pumped to a remote applicator for coating flat surfaces.

2. Prior Art

For many years, do-it-yourself painters had only a brush for applying coatings to surfaces. With the development of water-base paints, flat surfaces such as interior room walls and ceilings could be painted more readily with a roller or pad applicator. In most cases the applicator is dipped into a pan of paint until its transfer media, for example, a wool-like coat, is saturated with paint. The paint saturated coat of the applicator then is placed in contact with the surface to be painted and the applicator moved over surface to apply a layer of paint.

More recently, applicators have been made part of a pressurized system wherein paint is pumped from a remote source. U.S. Pat. No. 3,879,140 shows one such system where a motor driven pump sits on a paint container with the pump connected by a hose to an applicator. U.S. Pat. No. 4,175,300 sets forth another such system wherein a roller of the applicator may be operatively rotated at variable rates. A further pressurized paint delivery system is disclosed in U.S. Pat. No. 4,217,062. This system includes a peristaltic-type pump which delivers paint from a movable paint can carrying case to a remotely located paint roller. Various color paints can be applied to effect unusual patterns. In U.S. Pat. No. 4,231,668, a still further pressurized paint delivery system is shown. This still further system includes a planetary gear reducer connecting a peristaltic-type pump to a motor. The pump has a spring loaded plate which rotates to disengage a set of rotating rotor lobes from a piece of flexible hose when back pressure on the hose is excessive.

SUMMARY OF THE INVENTION

This inventive apparatus for applying liquid coatings includes an invertible peristaltic-type pump which may be placed on top of a one gallon paint container, for example, or inverted and located adjacent to the container. In each case, liquid coating is drawn into the pump through an intake line by interaction between a rotating impeller and a length of compressible tubing. Rollers on the impeller progressively flatten the tubing to create a one hand suction to draw liquid coating into the pump and then pressure ahead of the rollers to force the coating to flow through a hose to a remotely located applicator. A pressure switch having pressure sensing means deactivates a motor of the pump when there is no immediate demand for coating.

A roller-type applicator is connected to the pump through a handle provided with a pair of flow control pushbuttons mounted on the handle in an opposing manner. Regardless of whether the applicator is in a right-hand configuration or rotated 180 degrees to a left-hand configuration, one flow control pushbutton is readily accessible. A user may then feed liquid coating to the applicator as required to apply a layer of the coating to a wall surface, for example.

This apparatus for applying liquid coating has several advantages over similar apparatus presently known.

First, the pump is invertible so that it may be placed on top of a one gallon container or positioned remotely and draw coating material from a larger or smaller size container as may be required. Coating material thus may be purchased in container sizes most economically priced for the size of the project.

A second advantage provided by this apparatus is that the pump is only activated when the user needs coating material in the applicator. Energy use is reduced, and the life of the compressible tubing in the pump is extended since the tubing may be flattened by the rollers only a finite number of times before the tube must be replaced. Additionally, the internal components of the pump are accessible and readily replaceable. This secondary feature not only allows the pump to be disassembled for maintenance but also for cleaning when the coating applied is, for example, adhesive or has an organic base.

A further advantage is provided by the handle unit of the apparatus particularly when a roller-type applicator is used. A roller-type applicator must be turned over to be able to apply coating to opposite hand corners. The pair of opposingly positioned flow control pushbuttons allow the user to trigger a flow of coating to the applicator with a thumb or forefinger regardless of the position of the applicator. Since the applicator must be adeptly manipulated in such corners if the coating is to be correctly applied, these pair of flow control pushbuttons allow the user to supply just the right amount of coating material to the applicator at the right time.

A last advantage of this inventive apparatus is that it may be readily cleaned. Since the pump will pump liquid as well as air, coating material remaining in the apparatus when the project is completed can be pumped back into the container simply by allowing the pump to operate after disconnecting it from the source of coating material. The apparatus then may be flushed clean by connecting it to a source of a liquid cleaner, for example, warm water when the coating is a water-base material.

DESCRIPTION OF THE PREFERRED EMBODIMENT

Figure 1:
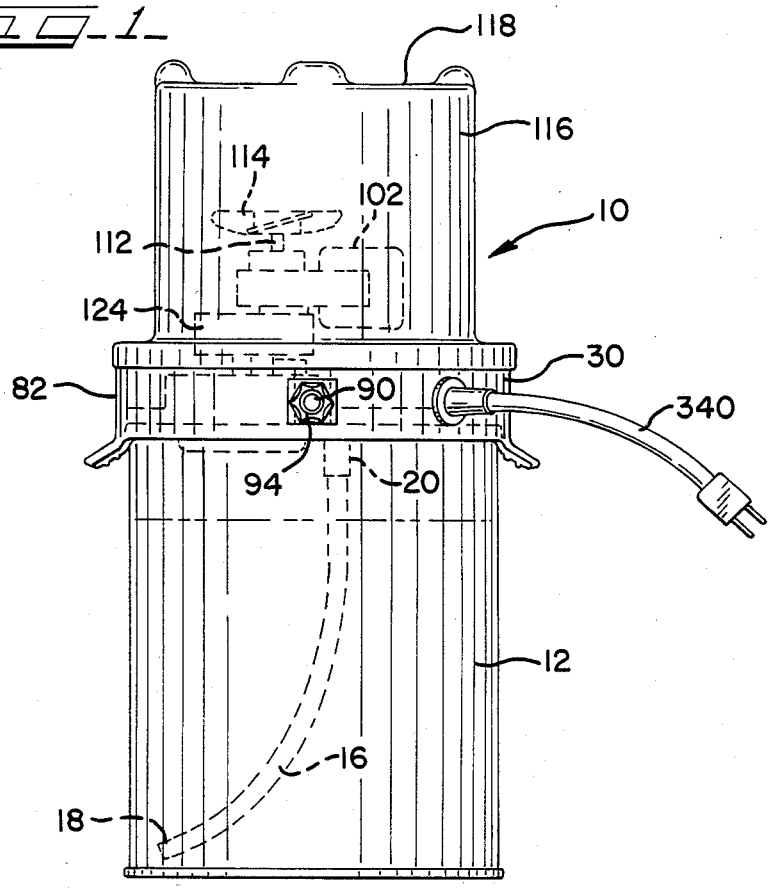
FIG. 1 is a perspective view of a pump of this invention positioned on a container of liquid coating.
Figure 2:
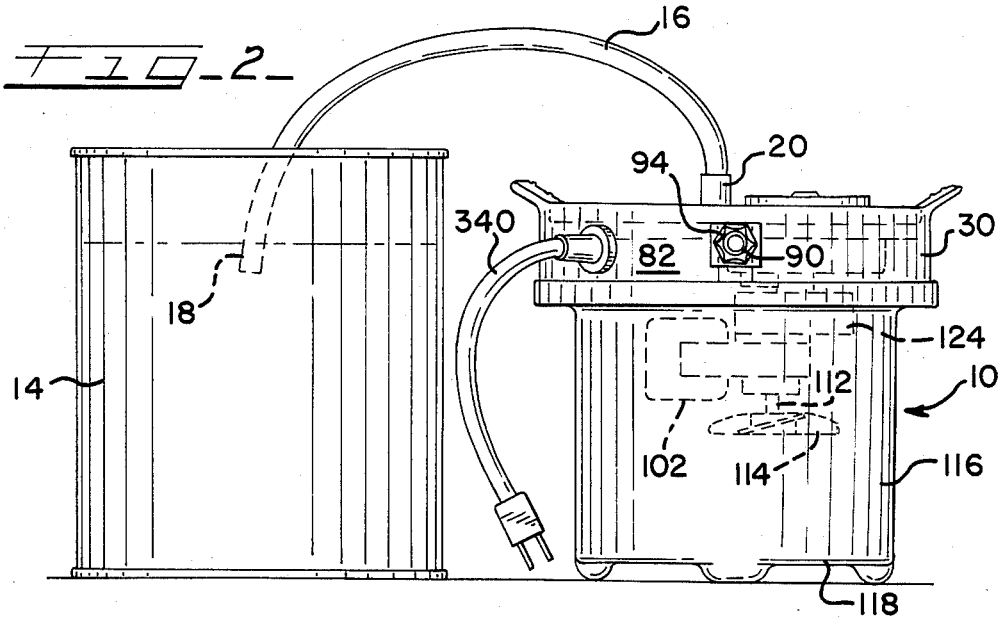
FIG. 2 is a further perspective view of the pump of FIG. 1 which has been inverted to a free standing position and connected to a larger size liquid coating container.

A pump 10 of this inventive apparatus for applying liquid coatings is shown in FIGS. 1-13. In FIG. 1, the pump 10 is fitted to a top on a one gallon container 12 of liquid coating. Alternatively, the pump 10 can be inverted to be free standing and positioned next to a further container 14. The container 14, as shown, is larger than the container 12 and could be two or five gallon in size, for example.

Whether the pump 10 is placed on the container 12 or merely next to it, an intake line 16 of the pump 10 is positioned within the container 12 so that an inlet end 18 is below a level of the liquid coating. An opposite end of the intake line 16 connects with an outer leg portion of an elbow fitting 20 which extends through and is secured in an opening 22 in a cover plate 24 shown in detail in FIGS. 3, 7, 8 and 9. An inner leg of the fitting 20 is positioned in a neck portion 26 of a recess area 28 formed in a partition 29 in a housing 30 of the pump 10. The housing 30 is shown in detail in FIGS. 3, 4, 5 and 6. The housing recess area 28 further includes a circular portion 32 having an arcuate vertical sidewall 34. The sidewall 34 extends approximately 300 degrees about the circular portion 32 and terminates to join a first and second sidewall 36, 38 of the recess area neck portion 26.

Joining the inner leg of the fitting 20 is an intake section 40 of a length of compressible tubing 42. The intake section 40 is positioned next to the first sidewall 36 of the recess area neck portion 26 and held thereagainst by a centrally located post 44. The length of tubing 42 further includes a compressible section 46 which is positioned next to the arcuate sidewall 34 of the recess area circular portion 32. The tubing compressible section 46 is joined by a first discharge section 48 positioned next to the second sidewall 38 of the recess area neck portion 26. Again the post 44 helps maintain the location of the tubing section 48. To further secure the position of the tubing intake section, compressible section and first discharge section 40, 46, 48 the cover plate 24 has a pair of spaced elements 50. Each element 50 has a concave shaped outer end to engage the tubing sections 40,48 respectively when the cover plate 24 is assembled to the housing 30 by a set of screws 52 which fit in holes 54 in the cover plate 24 to engage threaded apertures 56 in the housing 30.

Figure 4:
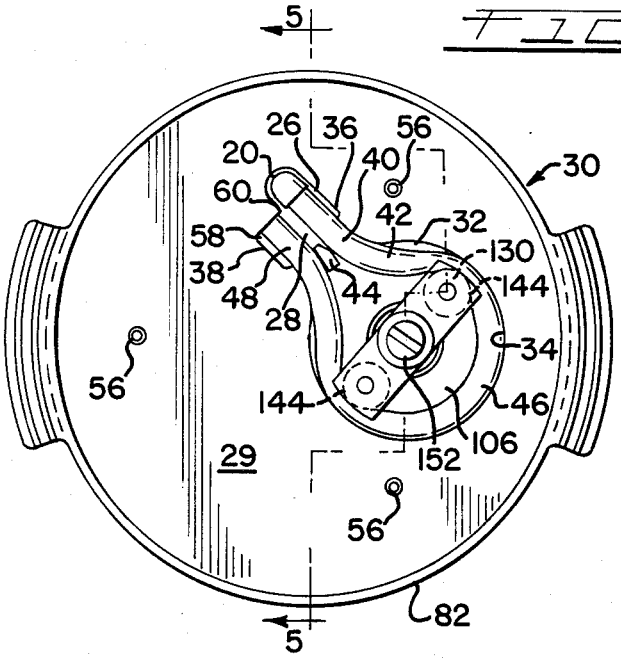
FIG. 4 is a bottom plan view of a housing of the pump of FIG. 1 as seen generally along the line 4—4 of FIG. 3.
Figure 5:
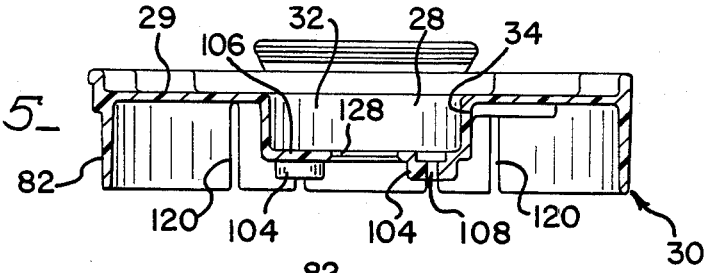
FIG. 5 is a cross section view of just the housing as seen generally along the line 5—5 of FIG. 4.
Figure 6:
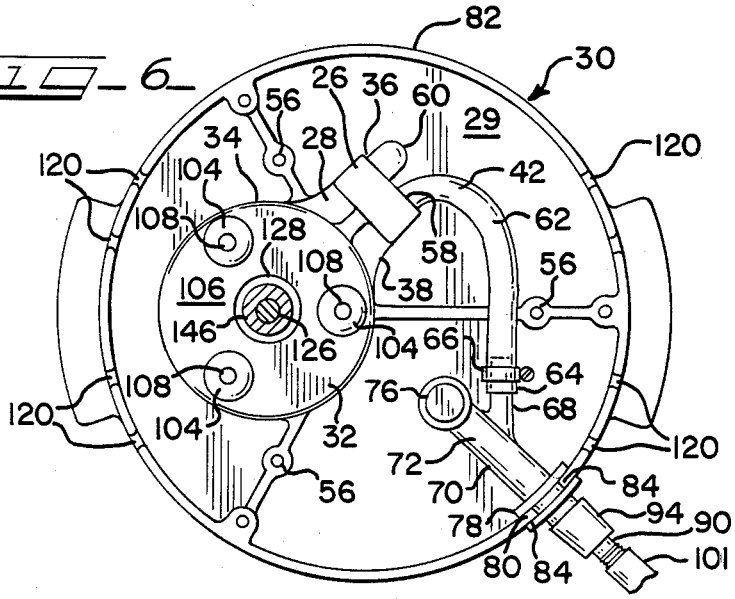
FIG. 6 is a top plan view as seen generally along the line 6—6 on FIG. 3.
Figure 7:
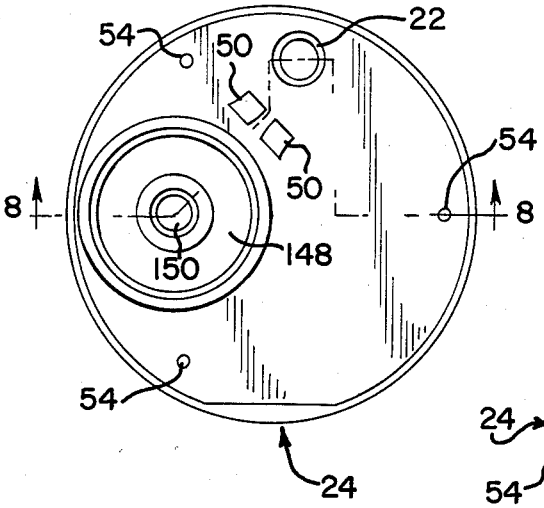
FIG. 7 is a top plan view of a cover plate of the pump as seen generally along the line 7—7 of FIG. 3.
Figure 9:
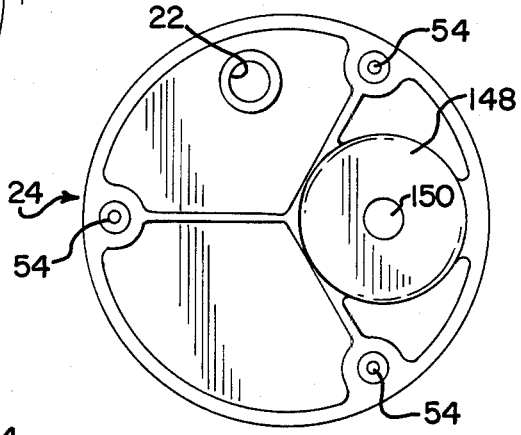
FIG. 9 is a bottom plan view of the cover plate as seen generally along the line 9—9 of FIG. 3.
Figure 8:
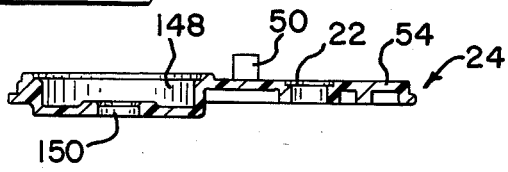
FIG. 8 is a cross section view as seen generally along the line 8—8 of FIG. 7.
Figure 10:
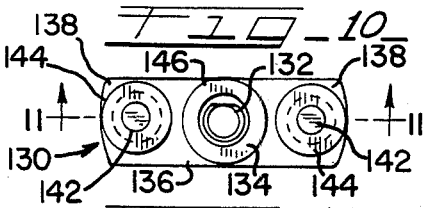
FIG. 10 is a top plan view of an impeller of the pump of FIG. 1.

The tubing first discharge section 48 extends through an opening 58 in an end wall 60 of the housing recess area neck portion 26, see FIGS. 4, 6. The first section 48 joins a second discharge section 62 located on the opposite side of the housing partition 29. An end 64 of the second discharge section 62 is secured by a clamp 66 to a serrated nipple 68 of a pressure switch fitting 70.

Figure 12:
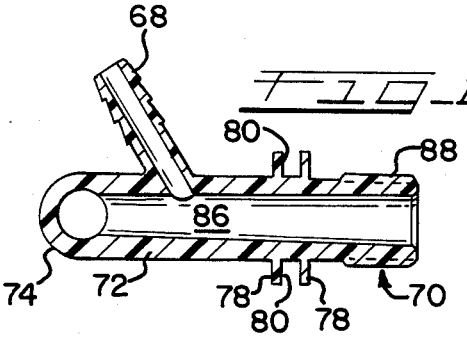
FIG. 12 is a cross section plan view of a pressure switch fitting seen in FIG. 6.
Figure 11:
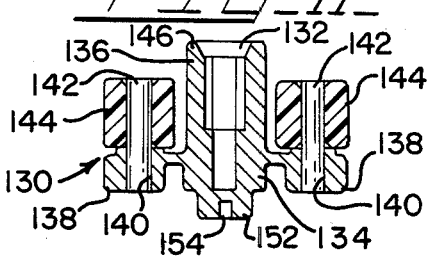
FIG. 11 is a cross section view as seen generally along the line 11—11 of FIG. 10.
Figure 13:
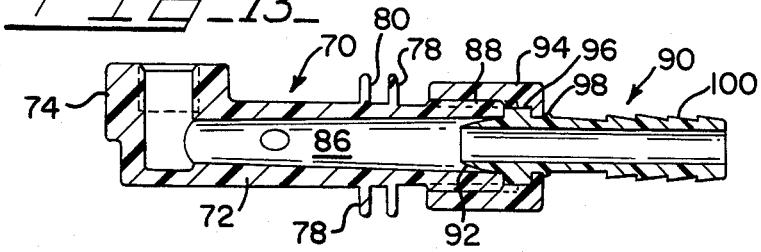
FIG. 13 is a cross section elevation view of the pressure switch fitting of FIG. 12 to which a hose disconnect fitting has been added.

The fitting 70 is shown in detail in FIGS. 6, 12 and 13 and includes a body portion 72. The nipple 68 projects outward, horizontally from the body portion 72 on an angle. Connecting with an inner end of the body portion 72 is an upward facing threaded coupling 74 to operatively receive a pressure switch 76. The preferred switch 76 is one made by Texas Instruments and identified as a KLIXON 20PS. A pair of spaced shoulders 78 formed about the fitting body portion 72 define a slot 80. An outer peripheral wall 82 of the housing 30 has a cutout such that spaced sidewalls 84 of the cutout fit into the slot 80 of the pressure switch fitting 70.

The pressure switch fitting 70 has an inner tapered passage 86 which connects the nipple 68 and the coupling 74 with an outer end 88 of the body portion 72 located outside of the housing outer peripheral wall 82. The outer end 88 is externally threaded. A disconnect fitting 90, see FIG. 13, has a rounded, crown shaped head 92 which fits into the inner passage 86 at the pressure switch fitting's outer end 88. A nut 94 is positioned on the disconnect fitting 90 between a shoulder 96 and a ring 98 formed on the fitting 90. The nut 94 may be threaded on to the external threads of the pressure switch fitting 70 to seal the fitting head 92 within the inner passage 86. The outer end 100 of the disconnect fitting 90 is serrated for attachment to an end of a length of hose 101 which may be secured with a clamp, not shown.

Figure 3:
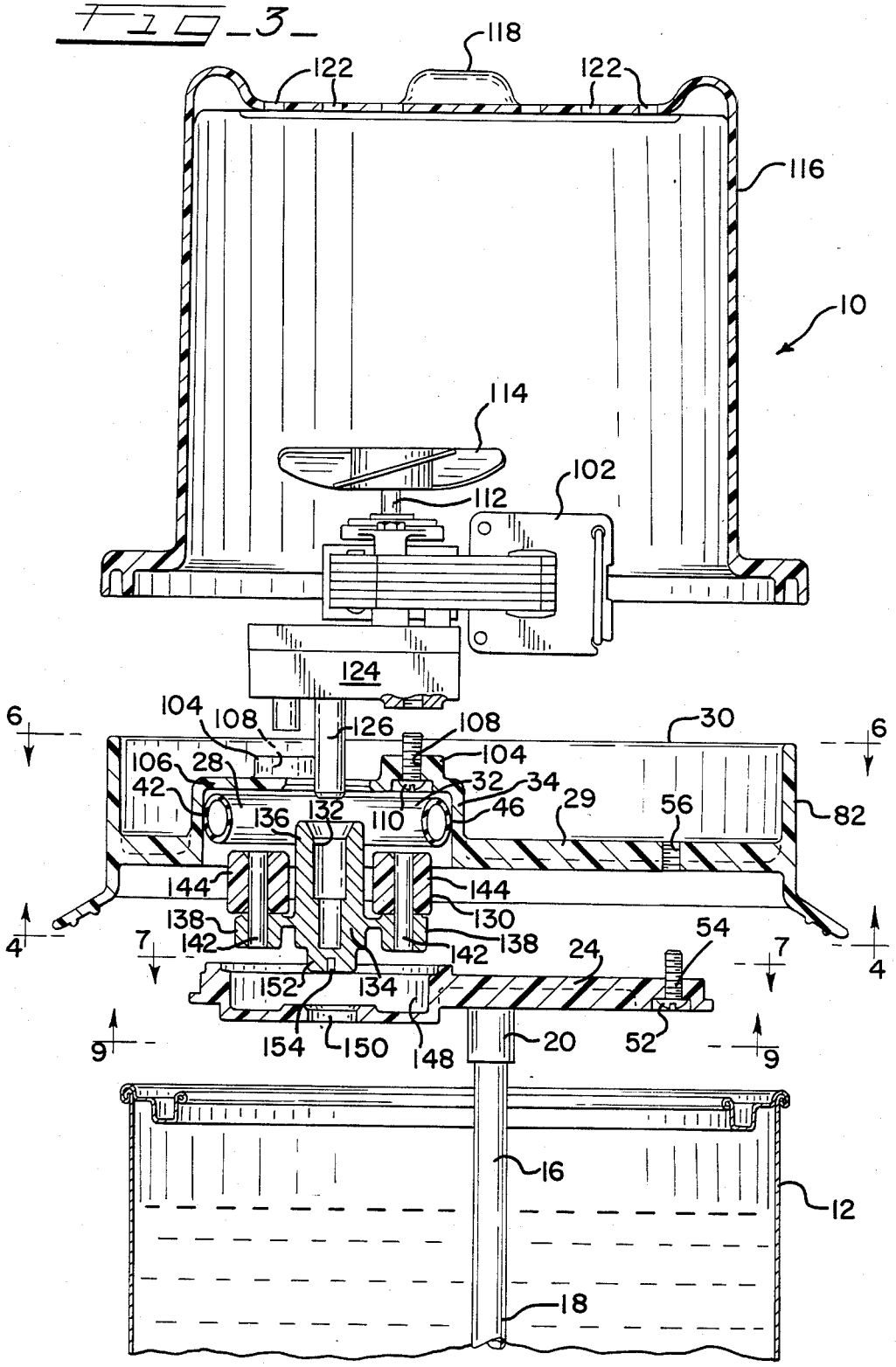
FIG. 3 is an exploded partial elevation view in section of the pump and container of FIG. 1.

As best understood by viewing FIGS. 3 and 6 a gear-type motor 102 is mounted on three equispaced bosses 104 formed on a top wall 106 of the housing recess circular portion 32. Each boss 104 has an aperture 108 for a screw 110 which threadedly engages with similarly positioned mounting holes in the motor 102. The preferred motor is made by Brevel Motors Inc. of Carlstadt, N.J. and identified as A.C. Gearmotor, Series Y. The motor 102 has a high r.p.m. shaft 112 to which a fan blade 114 is mounted. Attached to the housing 30 is a cover 116 which encloses the motor 102. The outer peripheral wall 82 of the housing 30 and an end wall 118 of the cover 116 are formed with air vents 120, 122, respectively, to allow cooling air to be circulated by the motor fan blade 114.

The motor 102 further includes a geared speed reduction portion 124 having a low r.p.m. output shaft 126. The shaft 126 extends through a circular opening 128 in the housing recess top wall 106 to operatively connect with an impeller 130, see FIGS. 3, 10 and 11. The shaft 126 fits in a central bore 132 formed in a body portion 134 of a rotor 136 of the impeller 130. Projecting outwardly on each side of the rotor body portion 134 is an arm 138. In each arm 138 is a further bore 140 to receive an end of a shaft 142. The shafts 142 extend from the arms 138 and each carries a roller 144 which is free to rotate on its respective shaft 142.

An end 146 of the rotor body portion 134 also fits within the housing recess circular portion top wall opening 128. The arms 138 of the impeller rotor 136 in turn fit in part in a circular recess 148 in the cover plate 24. A central opening 150 in the cover plate recess 148 receives an opposite end 152 of the impeller rotor body portion 134. The end 152 has a slot 154 to receive an end of a tool to assist fastening the impeller 130 to the motor shaft 126.

Figure 14:
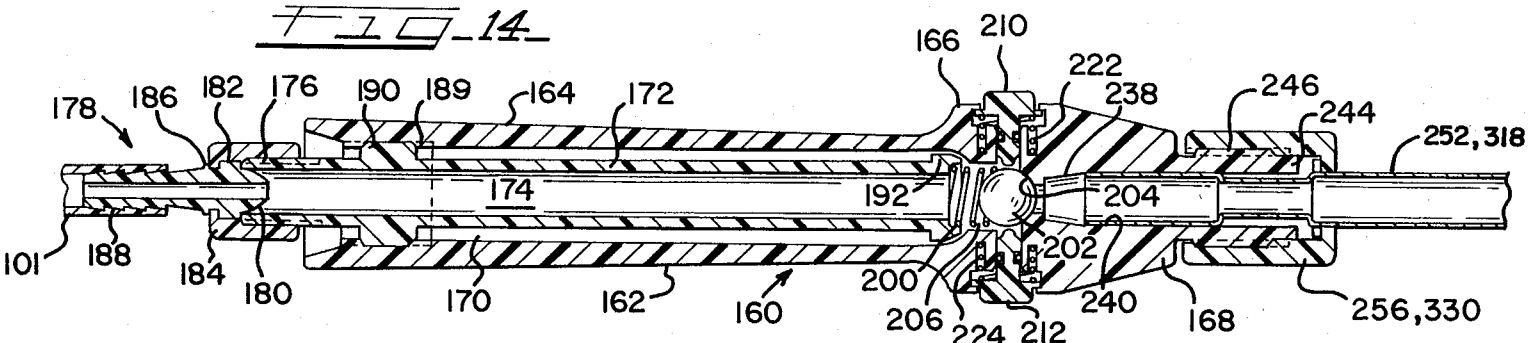
FIG. 14 is a cross section of a handle unit connectable to the pump of FIGS. 1 and 2.
Figure 15:
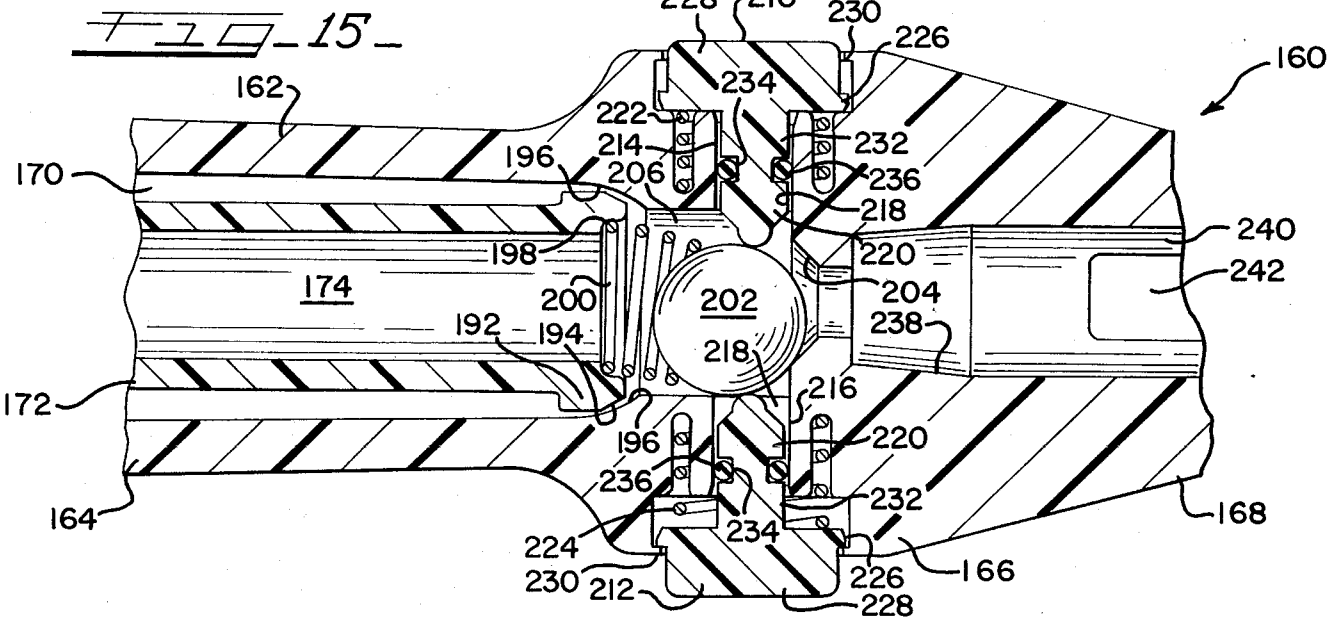
FIG. 15 is a detailed view of a flow control section forming part of the handle unit of FIG. 14.

This inventive apparatus for applying liquid coatings further includes a handle unit 160 shown in detail in FIGS. 14 and 15. The handle unit 160 includes a handle portion 162 having a hollow gripping section 164. The gripping section 164 joins a flow control section 166. The flow control section 166 connects with an attaching section 168. Within an inner space 170 of the handle unit gripping section 164 is an elongated handle fitting 172 having an inner passage 174. An outer end 176 of the fitting 172 extends beyond the handle gripping section 164 and is formed with external threads. The inner passage 174 at the fitting outer end 176 is inwardly tapered. A further disconnect fitting 178 has a like rounded, crown shaped head 180 which fits in a complimentary manner within the fitting inner passage 174. A shoulder 182 on the fitting 178 may be engaged by a nut 184 to maintain the fitting head 180 and inner passage 174 in a sealed relationship. An outer ring 186 on the fitting 178 secures the position of the nut 186. A serrated outer end 188 of the disconnect fitting 178 can be conveniently joined to an opposite end of the hose 101.

Within the handle portion gripping section inner space 170 are internal threads 189 for engagement with external threads 190 adjacent to the outer end 176 on the handle fitting 172. On an inner end 192 of the fitting 172 is a chamfered end wall 194 to seal against a radiused end wall 196 of the inner space 170. The two end walls 194, 196 are held compressively together by the threads 188, 190 of the handle portion 162 and the handle fitting 172 to form a seal therebetween.

The inner end 192 of the fitting 172 has an inner circular recess 198 to hold an end of a coil spring 200. An opposite end of the spring 200 is compressed against a ball valve 202. As best seen in FIG. 14, the ball valve 202 is in contact with a beveled end wall 204 of a valve space 206 in the handle unit flow control section 166.

The valve space 206 is sufficient in size to allow the ball valve 202 to move from engagement with the beveled end wall 204 when either of two pushbuttons, 210, 212 is depressed. The pushbuttons 210, 212 are positioned respectively in spaces 214, 216 formed in the handle portion flow control section 166. Each pushbutton space 214, 216 includes an opening 218 to receive a stem 220 of each pushbuttons 210, 212. The pushbuttons 210, 212 are biased outward by springs 222, 224 so that an outer ring 226 on a head portion 228 of each pushbutton 210, 212 is in contact with a flange 230 formed about an outer end of each pushbutton space 214, 216. Between the stem 220 and an intermediate portion 232 of each pushbutton 210, 212 is a circular recess 234 to hold an O-ring type seal 236 to form a seal about the pushbutton stem 220 and the pushbutton spaces 214, 216 respectively.

Adjacent to the beveled end wall 204 of the valve space 206 is a tapered section 238 which diverges outwardly to join a cylindrical passageway 240. On each side of the passageway 240 is a concave shaped recess 242. Only one such recess 242 is shown in FIG. 15 with both recesses 242 extending to an outer end 244 of the handle portion attaching section 168. The outer end 244 also includes external threads 246.

Figure 16:
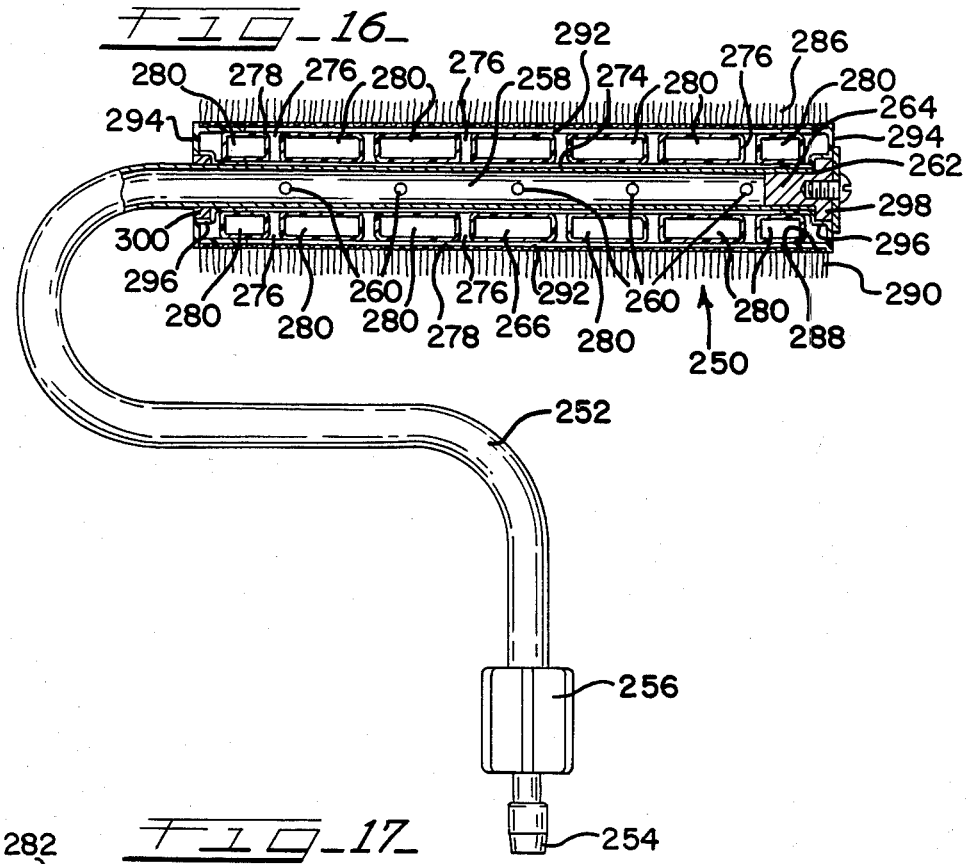
FIG. 16 is a plan view partially in section of a roller-type applicator.
Figure 17:
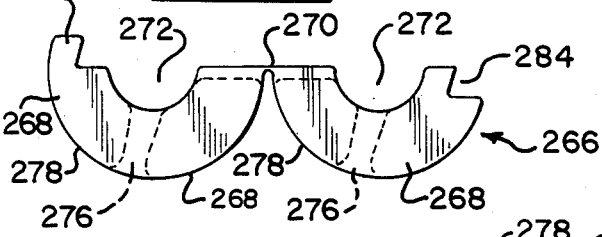
FIG. 17 is an elevation end view of a spacer of the applicator of FIG. 16 in its prefolded condition.
Figure 18:
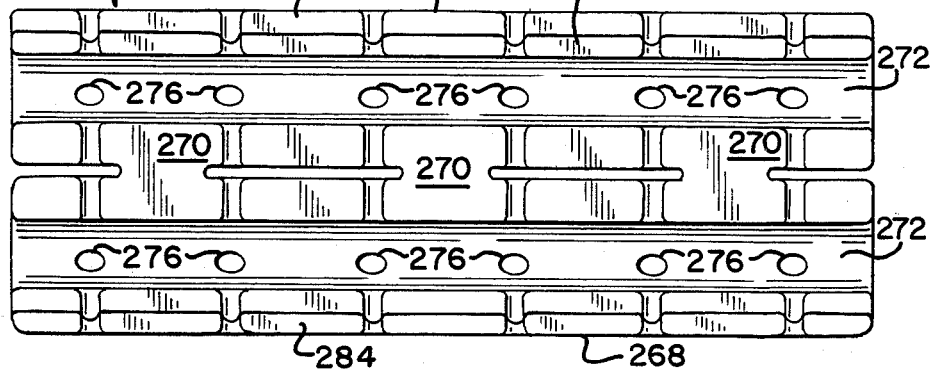
FIG. 18 is a top plan view of the spacer of FIG. 17.

In FIGS. 16, 17 and 18 is a coating applicator 250 and as shown is a roller-type device. It should be understood that coatings may be applied with other applicator types, for example with pads or brushes.

The applicator 250 included a rigid inlet tube 252 having a S-like configuration. An inlet end 254 is specially prepared to be complimentary received by and assembled to, for example, the outer end 244 of the handle unit 160 by a nut 256. This special preparation of the end 254 is discussed subsequently. The tube 252 includes discharge section 258 formed with a set of equispaced openings 260. In an outer end 262 of the tube discharge section 258 is a plug 264 to close the tube end 262. Positioned about the tube discharge section 258 is a spacer 266.

The spacer 266, shown in detail in FIGS. 17, 18, is formed by folding two semi-circular portions 268 together along a series of web segments 270 to create a circular inner passageway 272 in which the tube discharge section 258 is positioned. The diameter of the passageway 272 is greater than the diameter of the tube discharge section 258 to provide an inner coating flow space 274. Each spacer semi-circular portion 268 has a set of intermittently spaced ducts 276 which connect the flow space 274 with an outer surface 278 of the spacer 266. The ducts 276 are defined in part by a series of spaced semi-circular chambers 280. One semi-circular portion 268 has an elongated tongue 282 which fits into an offset 284 in the other semi-circular portion 268 to help maintain the spacer 266 in a cylindrical configuration.

Positioned about the spacer 266 is a coating applicator cartridge 286 having a porous inner cylindrical member 288 to which, for example, a wool-like coat 290 has been applied. The diameter of the cartridge inner member 288 is sufficiently greater than a diameter of the spacer outer surface 278 to form an outer coating flow space 292.

In each end of the cartridge 286 is an end cap 294 which forms a seal with the cartridge inner cylindrical member 288. Each end cap in turn is formed with a central recess 296. The plug 264 has an external rim 298 which fits in the one recess 296 while a collar 300 fits in the other. The plug rim 298 and collar 300 allow the cartridge 286 to rotate while at the same time seal off the end caps 294 from the tube discharge section 258.

Figure 19:
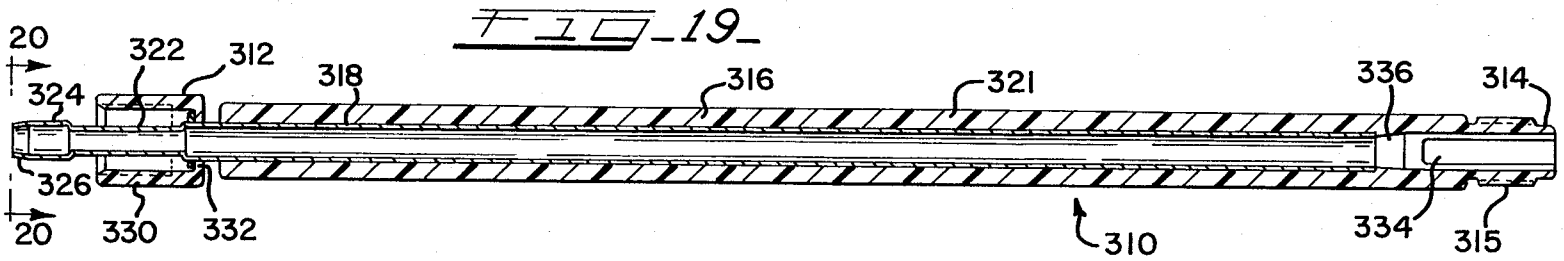
FIG. 19 is a cross section view of an extension connectable between the handle unit of FIG. 14 and the applicator of FIG. 16.
Figure 20:
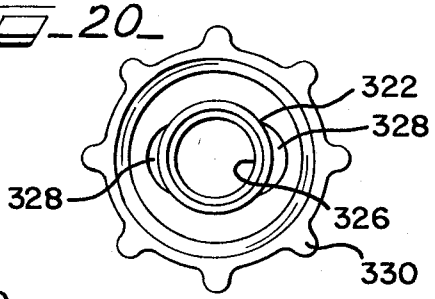
FIG. 20 is an end elevation view as seen generally along the line 20—20 of FIG. 19.
Figure 21:
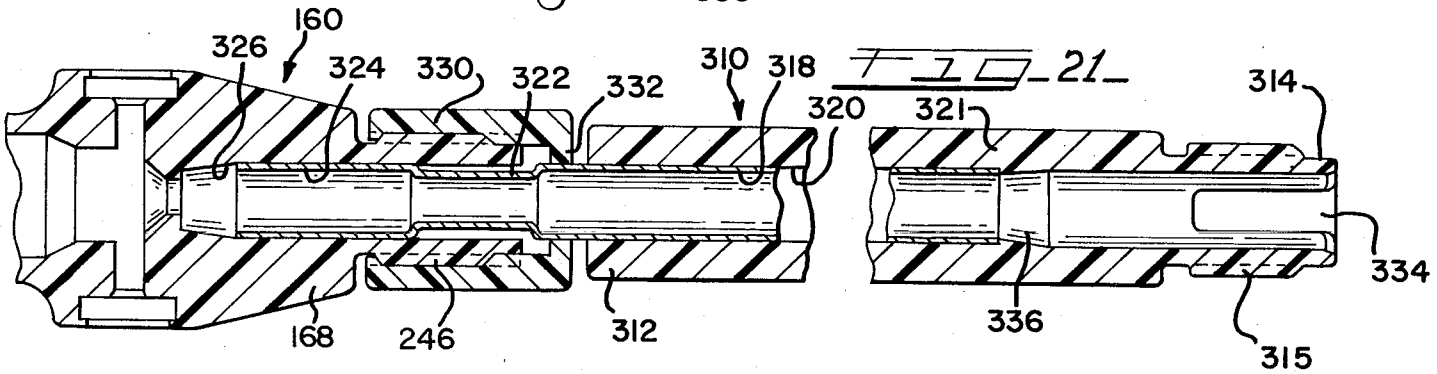
FIG. 21 is a cross section view showing the extension of FIG. 19 assembled to the handle unit of FIG. 14.

An extension 310 is shown in FIGS. 19, 20 and 21. The extension 310 may be positioned between the handle unit 160 and the applicator 250 allowing a user to apply coating to elevated surfaces, for example to a room ceiling or stairwell wall. In FIG. 21, one end 312 of the extension 310 is shown assembled to the handle unit 160.

An opposite end 314 of the extension 310 is prepared for assembly to the inlet end 254 of the applicator 250 and has external threads 315 for attachment with the nut 256. Between the ends 312, 314 is an elongated portion 316 comprising a length of rigid tube 318 in an inner space 320 of a sleeve 321. At the extension end 312 the tube 318 projects outwardly from the sleeve 321 and is formed with a neck section 322 having a reduced diameter. The neck section 322 connects with a cylindrical adapter section 324 having an inwardly tapered end 326. On each side of the neck section 322 is a convex shaped protuberant 328, see FIG. 20, which fits into the recesses 242 in the passageway 240 of the handle attaching section 168. A nut 330 having an inward formed flange 332 which fits snugly about the tube 318 may be screwed onto the threads 246 of the handle attaching section 168 to press the tube tapered end 326 into the tapered section 238 of the passageway 240 and form a seal.

It should be understood that the opposite end 314 of the extension 310 is likewise formed with a pair of recesses 334 and tapered section 336 in the same manner as the handle attaching section end 244 to receive the end 254 of the applicator 250 which is formed with protuberants and tapered end similar to those on the extension end 312.

To operate this inventive apparatus for applying liquid coatings, the inlet end 18 of the pump intake line 16 is submerged in a container of liquid coating, for example the container 12 is full of water-base paint. Ends of the hose 101 are connected to the serrated outer end 100 of the disconnect fitting 90 and the serrated outer end 188 of the disconnect fitting 178 attached to the handle unit 160. The applicator 250 may be connected directly to the handle unit 160 or connected through the extension 310 to the handle unit 160.

An electrical cord 340 carried by the pump 10 next may be connected to a 110 volt source of electrical current to energize the pump motor 102. The first shaft 112 of the motor 102 rotates the fan blade 114 at approximately 3500 r.p.m. while the second shaft 126 rotates the impeller 130 at approximately 120 r.p.m. As the rollers 144 on the impeller 130 alternately engage the compressible section 46 of the length of tubing 42, a suction is created in the intake line 16 and tubing intake section 40 to draw paint in behind each rotating roller 144. Paint in front of the rollers 144 in turn is forced into the tubing discharge sections 48, 62 under pressure Note that the flow of paint is continuous because as least one roller 144 is always engaging the compressible section 46 of the length of tubing 42. The discharge pressure may increase to approximately 40 p.s.i. if one of handle unit pushbuttons 210, 212 is not depressed to unseat the ball valve 202 and allow paint to flow to the applicator 250. When a pushbutton is so depressed, the pump 10 can deliver about 4.8 gals/hr. to the applicator 250.

When paint is not required by the applicator 250, for example because the cartridge 286 is sufficiently saturated to effectively transfer paint to a wall surface or because the applicator 250 is temporarily not being used, the pressure switch 76 senses an increase in paint pressure in the fitting 70. The switch 76 has normally closed contacts connected in series between the electric current source and the motor 102. When the paint pressure reaches a preselected upper limit, for example 40 p.s.i., the switch contacts open to deenergize the pump 10.

When further paint is required by the applicator 250, one of the pushbuttons 210, 212 is depressed to displace the ball valve 202 allowing paint to flow pass such. Paint pressure in the pressure switch fitting 70 in turn drops below the preselected level to close the switch contacts. The pump motor 102 is again energized to supply further paint to the applicator 250. Note that by only energizing the pump motor 102 as required to meet this intermittent demand, there is a savings of energy as well as a prolonging of the useful life of the length of tubing 42. As the rollers 144 engage the tubing compressible section 46, this tubing section 46 cycles between a compressed state and an expanded state. Since the tubing section 46 will fail after a finite number of such cycles, minimizing these cycles to the actual number required greatly extends tubing life.

Because of the S-like configuration of the applicator 250, the applicator 250 typically is rotated 180 degrees to allow its use in a right-hand corner or a left-hand corner respectively, so that its outer end 262 fits into the corner. As shown in FIG. 16, the applicator 250 is positioned for use in a right-hand corner. Regardless of which way the applicator 250 is rotated, one of the two pushbuttons 210, 212 on the handle unit 160 may be conveniently depressed by the user since one of the two pushbuttons 210, 212 is always accessible to the user's right or left-hand thumb.

When a pushbutton, for example the pushbutton 210 is depressed, the pushbutton stem 220 contacts the ball valve 202 to displace and unseat the ball valve 202 from the beveled end wall 204. Paint in the fitting inner passage 174 flows pass the ball valve 202, into the cylindrical passageway 240 and from there into the applicator tube 252. The paint then flows through the openings 260 and into the inner flow space 274 about the tube discharge section 258. Paint within the space 274 flows in opposite directions through the spacer ducts 276 to wet the cartridge inner member 288, be transferred to the cartridge wool-like coat 290 and on the wall surface.

Since more paint may be supplied to the cartridge 286 than is typically required for immediate application, the pushbutton 210 is released when the cartridge 286 is sufficiently saturated with paint. The spring 222 moves the pushbutton 210 outward until the pushbutton head portion external ring 226 engages the flange 230. As the pushbutton stem 220 disengages from the ball valve 202, the spring 200 advances the ball valve 202 against the beveled end wall 204 to inhibit any further flow of paint through the handle unit 160.

When the user has completed a particular task, the apparatus must be cleaned. To clean the apparatus, the intake line 16 is first removed from the container 12. With the applicator cartridge 286 placed in the container 12, one of the two handle pushbuttons 210, 212 is depressed to energize the pump 10. Air is drawn into the intake line 16 and through the length of tubing 42 in the pump 10 displacing the paint. Paint in the hose 101, handle unit 160, extension 310, if in use, and then the applicator 250 is returned to the container 12. With this paint removed, the apparatus next may be flushed with a solvent to remove any residual paint.

Figure 22:
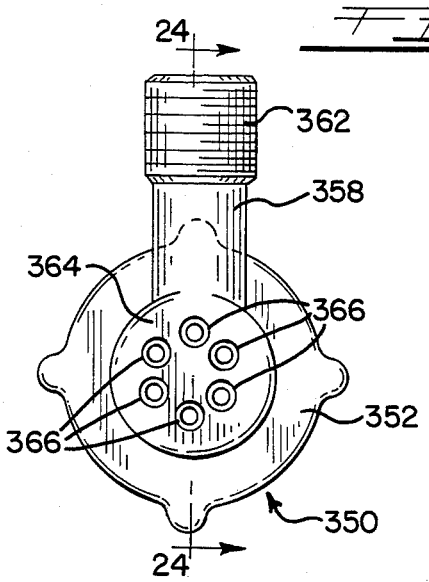
FIG. 22 is a bottom view of a cleanup adapter fitting.
Figure 23:
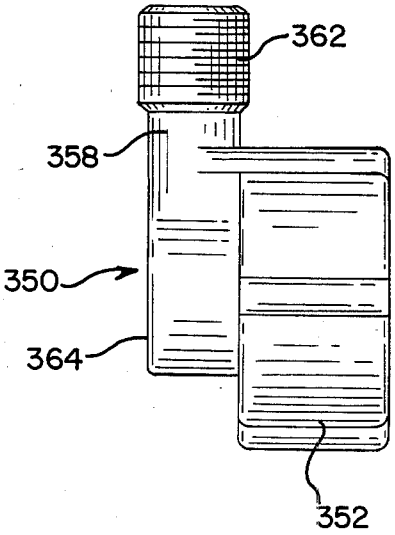
FIG. 23 is a side elevation view of the fitting of FIG. 22.
Figure 24:
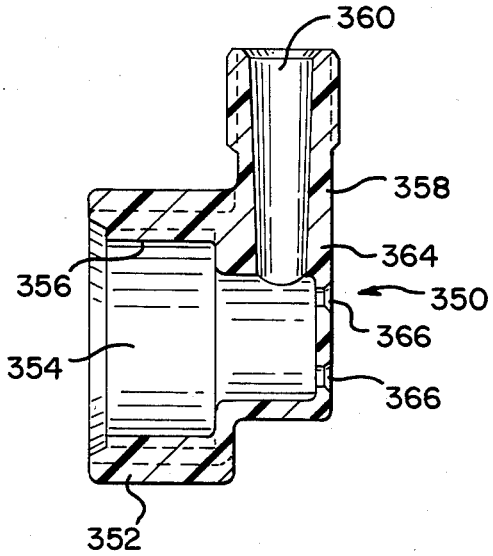
FIG. 24 is a section view as seen generally along the line 24—24 of FIG. 22.

When a water-base paint is used, the apparatus is best cleaned by flushing such with warm water. To facilitate cleaning the hose 101 and disconnect fitting 90 may be disassembled from the pump pressure switch fitting 70. The disconnect fitting 90 then may be reattached to a cleanup adapter fitting 350, see FIGS. 22, 23, and 24.

The cleanup adapter fitting 350 includes an inlet coupling portion 352 having an inlet passageway 354. The passageway 354 includes internal threads 356 for engagement with a threaded end of a garden hose or laundry tub faucet. The inlet coupling portion 352 connects with an outlet nipple portion 358, having an outlet passageway 360. The outlet nipple portion 358 includes external threads 362 for engagement with the disconnect fitting nut 94. A wall 364 of the fitting 350 is formed with a series of small openings 366 which allow the warm water to discharge preventing the pressure of such in the hose 101 to increase to an unsafe level.

While an embodiment of this invention has been shown and described, it sould be understood that the invention is not limited hereto except by the scope of the claims. Various modifications and changes can be made without departing from the scope and spirit of the invention as the same will be understood by those skilled in the art.

What we claim is:

1. Apparatus for applying liquid coating comprising a pump to draw said coating from a container and provide a pressurized flow of said coating through hosing to a handle unit connecting with an applicator, an improvement of said handle unit including, a handle portion having a gripping section formed with an inner space, a flow control section connecting with said gripping section and an attaching section connecting with said flow control section, a handle fitting disposed in said gripping section inner space with an inner end of said fitting engaging an inner end wall of said gripping section inner space to form a seal therewith and with threads formed adjacent to an outer end of said fitting to engage with threads formed as part of said gripping section inner space and provide a connection spaced from said seal, and said fitting outer end prepared for assembly with a disconnect fitting, a spring having an end carried in a recess formed on said handle fitting inner end, a ball valve positioned in a valve space formed in said handle portion flow control section and engaging with an opposite end of said spring to seal against a beveled end wall of said valve space, said valve space connecting with an inner passage in said handle fitting, flow control devices comprising a pair of pushbuttons positioned one each in pushbutton spaces formed respectively on opposite sides of said valve space and connecting therewith, each said pushbutton having a stem engageable with said ball valve to respectively and in combination disengage said ball valve from said valve space beveled end wall and a head portion biased outwardly by a spring in said pushbutton space to engage an outer ring on said pushbutton head portion with a flange formed at an outer end of said pushbutton space respectively, each said spring maintained free from contact with said coating by a sealing ring carried on each said pushbutton stem, a passageway formed in said handle portion attaching section and connecting with said valve space, said passageway including a tapered section positioned adjacent to said valve space and a pair of opposingly positioned recesses formed in said passageway, and threads formed on said attaching section adjacent to an outer end of said attaching section, wherein during apparatus use said handle fitting seal-connection spacing resisting external forces applied by said hosing attached to said disconnect fitting to maintain said handle fitting and said handle portion gripping section in leakproof relationship and an inlet of said applicator and an inlet of an extension being selectively secured in said attaching section passageway with said passageway tapered section engaging with a tapered end of said inlet to form a seal therewith, said passageway recesses engaging with protuberants formed on said inlet to maintain a position of said applicator and said extension in a selective relationship with said handle unit pushbuttons, and said handle unit attaching section threads forming a connection with a nut carried by said inlet spaced from said seal, said seal-connection spacing and said protuberant-recess engagement resisting external forces applied to said applicator and said extension to maintain said inlet and said handle unit attaching section in a leakproof relationship.

2. Apparatus for applying liquid coating as defined by claim 1 and further characterized by said pump including, a cover to freely support said pump with said pump in a first position, a housing attached to said cover to engage with said container and support said pump in a second inverted position, a cover plate attached to said housing on a side opposite said cover, said cover plate providing a removable closure over a recess formed in a partition of said housing, an intake line having an inlet end submergible in said liquid coating and an opposite end connecting with a length of tubing within said pump, a tubing intake section forming part of said tubing length and carried in a neck portion of said housing partition recess proximate a first sidewall of said housing partition recess neck portion, a tubing compressible section connecting with said intake section and carried in a circular portion of said housing partition recess proximate a sidewall of said housing partition recess circular portion, a tubing discharge section connecting with said tubing compressible section and carried in said recess neck portion proximate a second sidewall of said neck portion, said neck portion sidewalls joining said circular portion sidewall to form a limited opening in said circular portion sidewall sufficient for placement of said tubing sections and a post on said housing partition positioned between said tubing sections with said tubing discharge section extending through an opening in an end wall of said neck portion to be positioned on an opposite side of said partition and connect with a pressure sensing fitting carrying pressure sensing means, and an impeller operatively connected to a motor carried by said housing in said cover, said impeller having a rotor with a pair of arms each carrying a roller positioned in said housing partition recess circular portion to progressively engage and flatten said tubing compressible section to create positive and negative pressures on said liquid coating in said tubing with said rotor arms positioned in part in a circular recess formed in said cover plate.

3. Apparatus for applying liquid coating as defined by claim 2 and further characterized by said pressure sensing fitting including, a body having a serrated nipple extending within said housing for attachment by a clamp to said tubing discharge section, a coupling formed on an inner end of said fitting body for threaded engagement with said pressure sensing means, a pair of spaced shoulders on said body defining a slot to interact with sidewalls of a cutout in an outer peripheral wall of said housing to secure a location of said fitting, and an inner passage in said body to connect said nipple and said coupling with an outer end prepared for sealed engagement with a rounded, crown shaped head of a disconnect fitting connectable to said pressure sensing fitting by a nut.

4. Apparatus for applying liquid coating as defined by claim 1 and further characterized by said applicator including, a rigid tube having a S-like configuration with an end of said tube forming said applicator inlet, said inlet end having a neck section joining a cylindrical adapter section with said inlet tapered end connecting with said cylindrical adapter section and said protuberants formed on said neck section, and said tube having a discharge section formed with a series of intermittently space openings, a spacer loosely positioned about said tube discharge section with said spacer disposable within a cartridge having an outer coat for applying said coating to a surface with a position of said spacer within said cartridge maintainable by end caps placed in ends of said cartridge to form a seal between said cartridge and said tube discharge section while allowing free rotation of said cartridge, said spacer formed with a series of ducts to promote a flow of said coating between said tube discharge section and said cartridge coat.

5. Apparatus for applying liquid coating as defined by claim 1 and further characterized by said apparatus extension comprising, an elongated sleeve having a first end formed with external threads and an inner space extending between said first end and a second end, said inner space at said sleeve first end formed with a tapered section and a pair of recesses, and a tube disposed in said sleeve inner space with one end located adjacent to said sleeve first end tapered section and an opposite end projecting out from said sleeve second end and forming said extension inlet, said tube opposite end having a neck section joining a cylindrical adapter section with said extension tapered end connecting with said cylindrical adapter section and with said pair of protuberants formed on said neck section, wherein during apparatus use said applicator inlet may be secured in said extension first end with said first end tapered section engaging with said applicator inlet tapered end to form a seal therewith, said extension first end recesses engaging with said applicator inlet protuberants to maintain a position of said applicator in a selective relationship with said extension and said inlet nut engaging said extension first end threads to form a connection spaced from said seal, said extension first end seal-connection spacing and said extension first end protuberant-recess engagement resisting external forces applied to said applicator to maintain said extension first end and said applicator inlet in a leakproof relationship.

6. Apparatus as defined by claim 1 and further characterized by, a cleanup adapter fitting connecting to said handle unit handle fitting outer end, said cleanup adapter fitting having an inlet coupling portion prepared for connection with a domestic water supply and an outlet nipple portion prepared for connection to a disconnect fitting attached to said handle fitting outer end with a wall portion of said cleanup adapter fitting formed with a series of apertures to allow for a water discharge to maintain a level of pressure of said water supply below a selected limit.

* * * * *